United States Patent [19]

Graves

[11] Patent Number: 4,671,669

[45] Date of Patent: Jun. 9, 1987

[54] SOLAR SYSTEM CLOCK

[76] Inventor: Joseph R. Graves, 2132 Second Ave., Apt. 505, Seattle, Wash. 98121

[21] Appl. No.: 929,730

[22] Filed: Nov. 12, 1986

[51] Int. Cl.[4] ..... G04B 19/26

[52] U.S. Cl. ..... 368/17

[58] Field of Search ..... 368/15-20, 368/220, 223

[56] References Cited

U.S. PATENT DOCUMENTS

| | | | |
|---|---|---|---|
| 167,138 | 8/1975 | Troll | 368/16 |
| 1,153,492 | 9/1915 | Hoitinga | 368/16 |
| 1,416,605 | 5/1922 | Bulka | 368/16 |
| 1,750,505 | 3/1930 | Bulka | 368/16 |
| 2,943,435 | 7/1960 | Gorsuch | 368/18 |
| 3,183,659 | 5/1965 | Etienne | 368/238 |
| 3,766,727 | 10/1973 | Didik | 368/15 |
| 4,334,297 | 6/1982 | Oros | 368/18 |
| 4,435,795 | 3/1984 | Frank | 368/16 |
| 4,503,864 | 4/1986 | Graves | 368/17 |

*Primary Examiner*—Vit W. Miska

*Attorney, Agent, or Firm*—Norman B. Rainer

[57] ABSTRACT

A novelty clock is provided wherein a spherical representation of the earth revolves about a stationary depiction of the sun at the face of the clock as would a second hand. While revolving about the sun, the earth also rotates upon its own axis which is angularly disposed to the straight line between sun and earth. The earth's motion, in conjunction with depictions of other planets of the solar system, provides an appealing and realistic visual effect. The motion of the earth is achieved by a mechanism driven by rotation of the shaft which would otherwise drive the second hand of the clock.

6 Claims, 3 Drawing Figures

SOLAR SYSTEM CLOCK

BACKGROUND OF THE INVENTION

This invention relates to a clock, and more particularly concerns a clock whose face is provided with a centered representation of the sun and a sphere which represents earth and rotates about the face with movement of the time-indicating hands.

Conventional techniques for displaying time are well known to all and include numerical displays, rotating hands, and the like. Clocks which further provide moving displays for educational purposes or visual attractiveness are also well known. The depiction of aspects of the solar system on clock faces has been disclosed, but such clocks are either of complex construction or involve minimal movement of the visually attractive components.

U.S. Pat. No. 4,583,864 discloses a clock wherein a spherical representation of the earth is caused to rotate about a stationary central depiction of the sun. During such rotation, the earth sphere also spins on its axis, thereby providing a realistic display of actual solar system motions. However, the earth sphere of said patent is constrained to rotation in a manner wherein the earth's axis is constantly oriented toward the center of the sun, thereby erroniously causing the earth's south pole to be continually directed toward the sun. Furthermore, the clock of U.S. Pat. No. 4,583,864 provides for only one axial rotation per orbital revolution about the sun, and does not depict other important aspects of the solar planetary system.

It is accordingly an object of the present invention to provide a clock which realistically depicts movement of the earth around the sun.

It is a further object of this invention to provide a clock as in the foregoing object wherein the earth is represented by a sphere which undergoes numerous axial rotations while undergoing a single orbital revolution around the sun.

It is another object of the present invention to provide a clock of the aforesaid nature which additionally demonstrates interrelationships of other planets of the solar system.

It is a still further object of this invention to provide a clock of the aforesaid nature amenable to economical manufacture by way of simple modification of clocks of conventional design.

These objects and other objects and advantages of the invention will be apparent from the following description.

SUMMARY OF THE INVENTION

The above and other beneficial objects and advantages are accomplished in accordance with the present invention by a clock comprising:

(a) a timing mechanism, (b) a generally flat circular face having depictions of planets of the solar system at locations which would otherwise be occupied by hour numbers, (c) coaxial drive shafts centrally positioned in said face and rotated by said timing mechanism to accommodate hour, minute and second hands, (d) a transparent cover having a circular outer perimeter mounted upon said face in spaced apart relationship therewith, said cover having interior and exterior surfaces, (e) an opaque representation of the sun centrally affixed to said cover, and (f) a motion producing mechanism comprising:

(1) extension means in parallel disposition to said face having a proximal extremity coupled to the drive shaft for said second hand and a distal extremity radially removed from said drive shaft, (2) axle means associated with said distal extremity and disposed at a forward angle relative to the clockwise direction, said axle means terminating in an outermost extremity disposed between the sun and outer perimeter of said cover, (3) a substantially spherical representation of earth associated with said outermost extremity in coaxial alignment with said axle means, (4) moving gear means mounted upon said axle means and adapted to rotate in substantially perpendicular disposition to said face, and (5) stationary gear means affixed to the interior surface of the cover in annular relationship to the center thereof and within the border of the opaque representation of the sun, and adapted to engage and rotate said moving gear means, whereby (6) movement of the shaft intended to drive a second hand rotates the earth in a circular path around the sun and simultaneously produces rotation of the earth about an axis angularly disposed to the straight line between the centers of the sun and earth.

In a preferred embodiment of the invention, the extension means has, at its distal extremity, a channeled bushing or equivalent means to rotatively support a straight axle. In certain embodiments of the invention, the axle means may be comprised of a terminal portion of said extension means bent away from the radial direction and rotatively supporting an elongated sleeve. The number of teeth on the moving gear is preferably considerably less than the number of teeth on the stationary gear, thereby producing more than one rotation of earth per revolution about the sun. The forward angle, measured as the intersection of the axis of the axle means with a radius line between the centers of the sun and earth, has a value preferably between 15 and 45 degrees.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
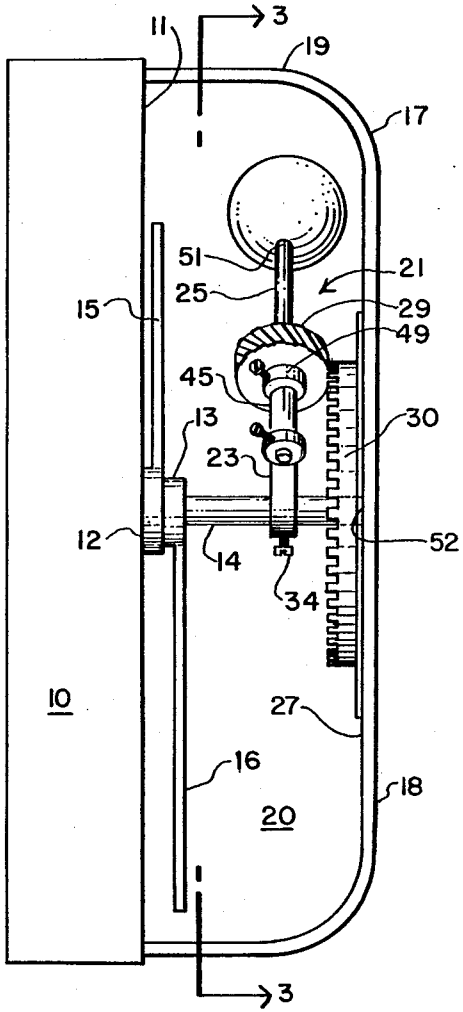
FIG. 1 is a side view of an embodiment of the clock of the present invention.

For convenience in description, the terms "interior" or words of similar import will have reference to the interior of the region bounded by the clock face and cover as shown in FIG. 1. The expressions "forward" and "rearward38 and equivalents thereof will have reference to locations adjacent the cover and face, respectively.

DESCRIPTION OF THE PREFERRED EMBODIMENT

Figure 2:
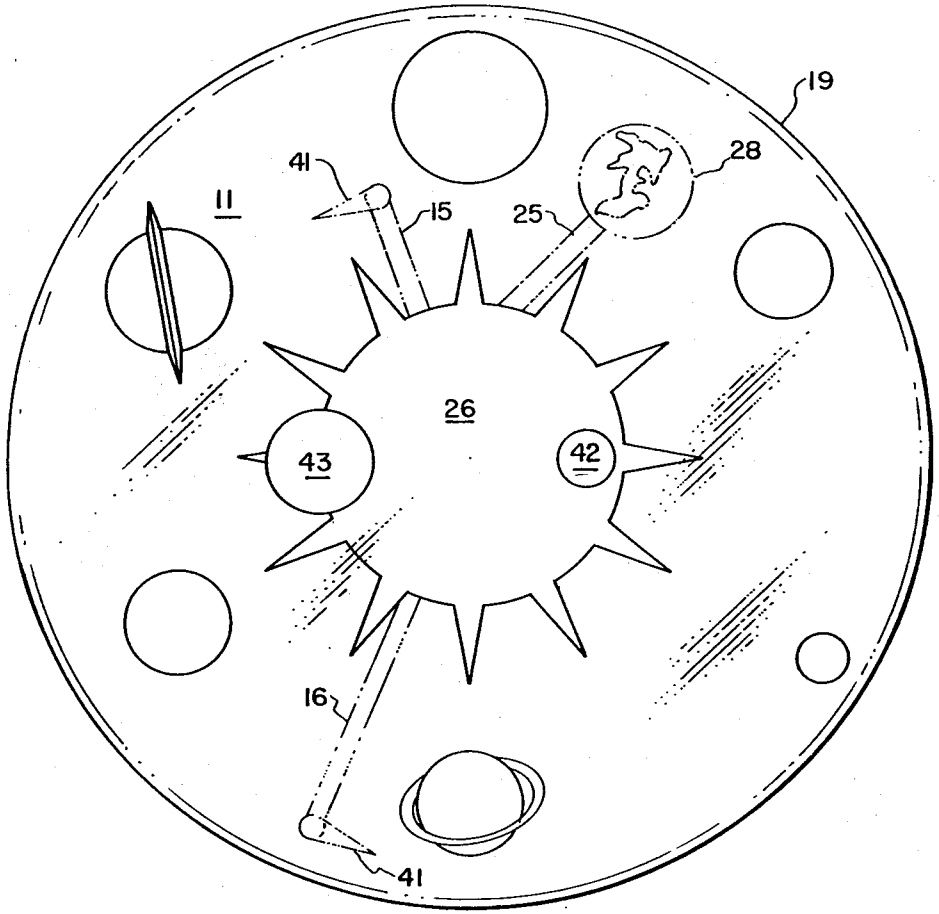
FIG. 2 is a front view of the clock of FIG. 1.
Figure 3:
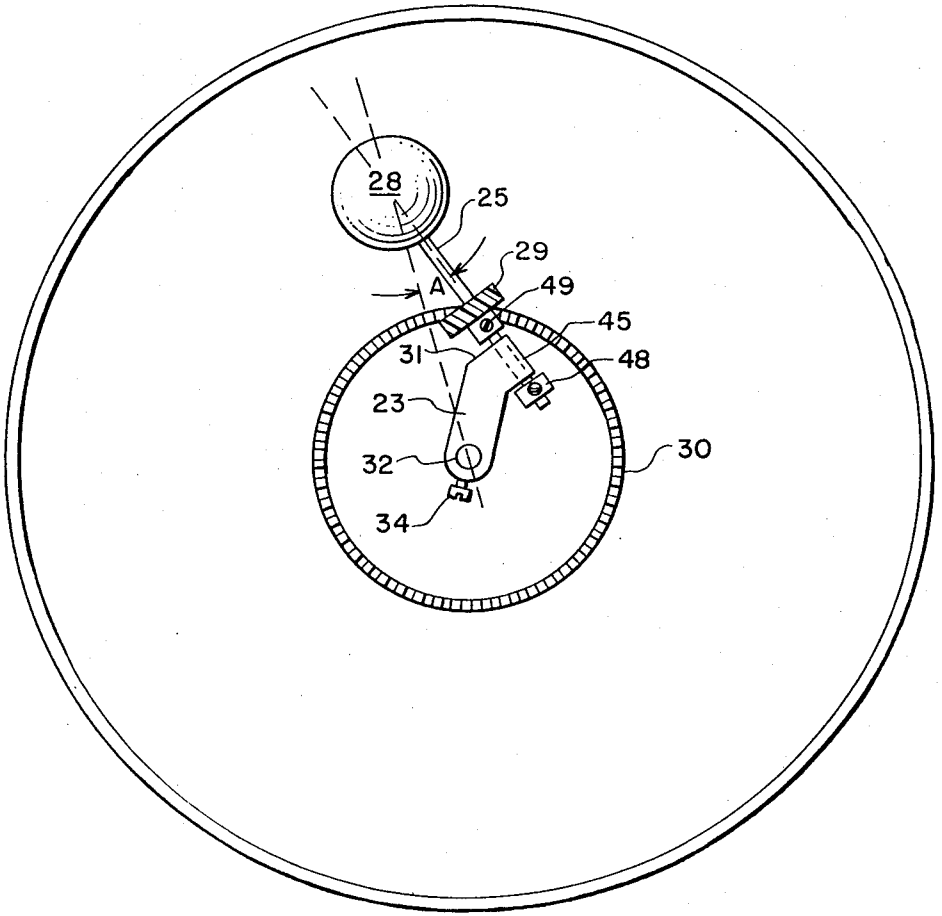
FIG. 3 is a sectional view taken along the line 3—3 of FIG. 1.

Referring to FIGS. 1–3, an embodiment of the clock of the present invention is shown comprised of housing 10 which encloses a timing mechanism of conventional design driven preferably by an electrical motor, a time-indicating flat face 11 of circular perimeter forwardly enclosing said timing mechanism, and concentric drive shafts 12, 13 and 14 extending from the timing mechanism through the center of said face and adapted to drive the hour, minute and second hands, respectively. Second hand drive shaft 14 is elongated beyond the usual length of such drive shaft typical of conventional clocks. Hour hand 15 and minute hand 16 are attached to their respective drive shafts. The extremities of said hour and minute hands are provided with depictions of comets 41 traveling in the clockwise direction of the hands. No conventional second hand is associated with shaft 14.

The face 11, instead of having conventional time-indicating numerical indicia, is provided with representations of the planets of the solar system. Accordingly, Jupiter is shown at the usual 12 o'clock position on the face, Mars is shown at 2 o'clock, Pluto at 4 o'clock, Saturn at 6 o'clock, Neptune at 8 o'clock, and Uranus at 10 o'clock. The depictions of the planets are seen to have varied sizes generally commensurate with the relative actual sizes of the planets. Saturn and Uranus are further realistically illustrated as having annular rings.

A transparent integral cover 17 comprised of flat forward panel 18 and encircling sidewall 19 is affixed to the clock in front of face 11, forming a protective enclosure 20. An opaque flat representation of the sun 26 is centrally affixed to the interior surface 27 of panel 18. Superimposed upon the outwardly visible surface of the sun 26 are indicia 42 and 43 representing the planets Mercury and Venus, respectively. The reason Mercury and Venus are positioned within the representation of the sun is that said planets are in fact located between the sun and the earth within the actual solar system. Therefore, for educational purposes the aforesaid placement of Venus and Mercury provides a more realistic picture of the solar system.

A motion producing mechanism 21, confined within enclosure 20, is driven by shaft 14 whose axis of elongation passes through the center of face 11, said shaft having a forward extremity 52. Said motion producing mechanism utilizes a flat extension bar 23 having an aperture 32 adjacent its proximal extremity and an angled portion 31 adjacent its distal extremity. Shaft 14 penetrates aperture 32 and affixes said extension bar in parallel juxtaposition to face 11 by means of set screw 34. A cylindrical bushing channel 45 is formed within angled portion 31. A straight cylindrical axle 25 is rotatably held by channel 45, and positioned therein by first and second holding collars, 48 and 49, respectively. Attached to the outermost extremity 51 of axle 25 is a substantially spherical representation of earth 28 located radially beyond the sun 26. The earth contains printed indicia suggesting that its axis of rotation, namely the axis of axle 25, is along the north and south poles of the earth. The forward angle of inclination of the earth's axis with respect to the center of the sun, shown as angle A in FIG. 3, is about 20 degrees, and may range in general between 15 and 45 degrees.

A moving gear in the form of helical gear 29 is perpendicularly mounted upon axle 25 in abutment with collar 49. A stationary gear, in the form of crown gear 30, is adhered to the sun on the interior surface 27 of forward panel 18 in annular relationship to the center thereof, and is adapted to engage and rotate said moving gear. Bushing means may be attached to surface 27 at the center of crown gear 30 for the purpose of supporting forward extremity 52 of shaft 14. In other embodiments, said moving and stationary gears may be pinion and crown gears, bevel gears, or mechanisms of equivalent alternative design permitting the sought functional interaction.

By virtue of the aforesaid construction of the motion producing mechanism, when the drive shaft for the second hand is turned by the timing mechanism, the earth moves in a circular orbital path around the sun and simultaneously rotates upon its own axis. During such axial rotation, the temperate zone of the earth is realistically disposed to the sun. Such two-fold motion is educationally realistic and further serves as a visually attractive display. As best shown in FIG. 2, the diameter of the sun is large enough to obscure the underlying motion producing mechanism.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A clock comprising:

(a) a timing mechanism, (b) a generally flat circular face having depictions of planets of the solar system at locations which would otherwise be occupied by hour numbers, (c) coaxial drive shafts centrally positioned in said face and rotated by said timing mechanism to accommodate hour, minute and second hands, (d) a transparent cover having a circular outer perimeter mounted upon said face in spaced apart relationship therewith, said cover having interior and exterior surfaces, (e) an opaque representation of the sun centrally affixed to said cover, and (f) a motion producing mechanism comprising:

(1) extension means in parallel disposition to said face having a proximal extremity coupled to the drive shaft for said second hand and a distal extremity radially removed from said drive shaft, (2) axle means associated with said distal extremity and disposed at a forward angle relative to the clockwise direction, said axle means terminating in an outermost extremity disposed between the sun and outer perimeter of said cover, (3) a substantially spherical representation of earth associated with said outermost extremity in coaxial alignment with said axle means, (4) moving gear means mounted upon said axle means and adapted to rotate in substantially perpendicular disposition to said face, and (5) stationary gear means affixed to the interior surface of the cover in annular relationship to the center thereof and within the border of the opaque representation of the sun, and adapted to engage and rotate said moving gear means, whereby (6) movement of the shaft intended to drive a second hand rotates the earth in a circular path around the sun and simultaneously produces rotation of the earth about an axis angularly disposed to the straight line between the centers of the sun and earth.

2. The clock of claim 1 wherein the extension means has at its distal extremity a channeled bushing which rotatively supports said axle means.

3. The clock of claim 1 wherein the number of teeth on the moving gear means is considerably less than the number of teeth on the stationary gear means, thereby producing more than one rotation of earth per revolution about the sun.

4. The clock of claim 1 wherein the locations of the depictions of the planets are such as to be roughly indicative of their positions within the solar system.

5. The clock of claim 1 wherein said motion producing mechanism is substantially obscured from view by the opaque representation of the sun.

6. The clock of claim 1 wherein said forward angle of the axle means is between 15 and 45 degrees.

* * * * *